United States Patent [19]
Pol et al.
[11] 3,977,461
[45] Aug. 31, 1976

[54] CONTINUOUS MECHANICAL IRON POURING LINE

[75] Inventors: Kenneth J. Pol, Saginaw; William E. Willis, Frankenmuth, both of Mich.

[73] Assignee: General Motors Corporation, Detroit, Mich.

[22] Filed: Jan. 8, 1976

[21] Appl. No.: 647,654

Related U.S. Application Data

[63] Continuation-in-part of Ser. No. 372,337, June 21, 1973, abandoned.

[52] U.S. Cl. ..... 164/155; 164/323; 164/335

[51] Int. Cl.[2] ..... B22D 41/12; B22D 47/00

[58] Field of Search ..... 164/323, 335, 155

[56] References Cited

UNITED STATES PATENTS

| | | | |
|---|---|---|---|
| 3,095,620 | 7/1963 | Peras | 164/335 X |
| 3,495,720 | 2/1970 | Mann et al. | 105/153 X |

*Primary Examiner*—Robert D. Baldwin
*Attorney, Agent, or Firm*—Lawrence B. Plant

[57] ABSTRACT

A continuous mechanical iron pouring line for pouring molten metal into a moving conveyor line of abutting sand molds. A plurality of pouring ladles mounted on independently driven and controlled carriages move along a track in a closed-loop between: (1) a stationary ladle filling station wherein molten metal flows from a stationary holding vessel into the ladle; (2) a pouring station wherein the molten metal is conveyed from the ladle into an associated moving mold as the ladle and mold move together through the pouring station; and (3) back to the filling station. Control of each carriage is effected by interaction of that carriage with preceding and succeeding carriages. At the pouring station, the mold line parallels the track along which the carriages move and defines a sector wherein the metal may be poured. Within this sector, locating means carried by each carriage engage the associated mold so as to synchronize the movement of the carriage with that of the mold, such that the ladle pouring spout is located and maintained in registry with the moving mold during the pouring operation. At the beginning of the pouring station, each ladle is located with its associated mold when sensing and control means carried by the ladle carriage engage the preceding ladle carriage and activates a locating means. After emptying its contents, the preceding ladle carriage senses whether the following ladle carriage is engaged or not, and if engaged, the emptied ladle's locating means is disengaged and the ladle then driven to the filling station to be resupplied with molten metal.

10 Claims, 15 Drawing Figures

CONTINUOUS MECHANICAL IRON POURING LINE

This is a continuation-in-part of U.S. Pat. Application Ser. No. 372,337 (now abandoned) filed June 21, 1973 in the names of Kenneth J. Pol et al and assigned to the assignee of the present invention.

The present invention relates to foundry apparatus and, in particular, to a continuous mechanical pouring line for completely automatically and sequentially: pouring predetermined amounts of molten metal from a holding vessel into a plurality of ladles each adapted to receive said predetermined amount; conveying that predetermined amount of molten metal to a continuously moving mold line; linking each ladle to a separate mold adapted to receive that predetermined amount; discharging the metal from each ladle while moving through a pouring station at a rate determined by the rate of the mold line; and thereafter returning each ladle to the holding vessel for refilling.

To increase production, reduce unit costs, and improve product quality, automated casting apparatus is being increasingly used by the foundry industry. Generally this automation takes the form of a continuous moving mold line which parallels a pouring station whereat molten metal is transferred from a single ladle into a plurality of molds. Where manual pouring is involved, the operator's movement is coordinated with line speed and the operator transfers molten iron from the ladle into a series of molds before refilling the ladle. At least one system has been proposed where a plurality of ladles service a plurality of molds on a one-to-one basis as they move together through a pouring station, and in which the ladle to be poured is manually disconnected from a chain driving the other ladles and thereafter manually positioned and connected to the mold for driving thereby through a pouring station. Where automatic pouring is involved, the ladle on the pouring machine is coordinated with mold line speed and pours its molten metal charge sequentially to a series of molds. Between pourings the ladle usually returns (i.e., reciprocates) to a predetermined starting position before joining and pouring the next mold.

The present invention provides a completely automatic continuous pouring line wherein a plurality of self-powered and self-controlled ladles travel from a source of molten metal to a moving chain of molds moving along a conveyor. Each ladle carries a metered amount of molten metal sufficient for one of the molds in the chain, is independently driven around a closed-loop circuit from the source of stationary filling station to synchronization with the moving mold line for pouring and thereafter returned to the filling station for refilling. The present invention contemplates eliminating manually pouring and/or manually positioning of the ladles with respect to the molds as well as elaborate means to synchronize ladle movement with mold movement in which the movement and locating of each ladle is automatically controlled by the location and status of the immediately preceding and succeeding ladles. The several ladles are mounted on self-powered and self-controlled carriages which move unidirectionally around a closed-loop circuit (e.g,. along a circular track). Each carriage dwells at the filling station while its ladle receives a metered amount of metal, and is thereafter rapidly driven to the pouring station, which comprises a sector of the closed-loop circuit parallel to the mold line for movement therethrough while discharging its contents into an associated mold. Each carriage entering the pouring station is synchronized with its associated mold by engagement with a preceding ladle carriage. In this regard when the entering carriage engages the preceding carriage, a locating cylinder couples or locks the entering carriage onto its associated mold for movement therewith through the pouring station at a rate determined by the mold speed and such that the ladle pouring spout is maintained in registry with the mouth of the mold. While moving through the pouring station, a pouring sequence is initiated for discharging the molten metal from the ladle to its associated mold. When the ladle has discharged its contents and its carriage senses the presence of a succeeding carriage, the mold locating cylinder is disengaged and the carriage with the empty ladle is rapidly returned to the filling station. In this manner important advantages are achieved. By sizing each ladle for precisely the amount of molten metal needed for each mold, a short fill time can be devoted to each ladle rather than a long filling time necessitated when a series of molds are filled from each ladle. This reduces the cooling of the molten metal between the filling and pouring operations. Moreover, by controlling and locating each carriage/ladle relative to its associated mold by reference to and engagement with preceding and succeeding carriages/ladles and by directly engaging the carriages/ladles with the mold line, elaborate synchronization drives and carriage/mold seeking devices for either or both the carriages and molds are not necessary to locate and maintain the pouring spout in registry with the associated mold during the pouring. Lastly, the total independence of the drive and control system for each carriage permits ready removal for servicing and complete freedom of movement thereof for its rapid return to the fill station following completion of its pouring sequence and disengagement from its associated mold.

The above and other features of the present invention will be apparent to one skilled in the art upon reading the following detailed description, reference being made to the accompanying drawings illustrating certain embodiments of the present invention in which.

Figure 1:
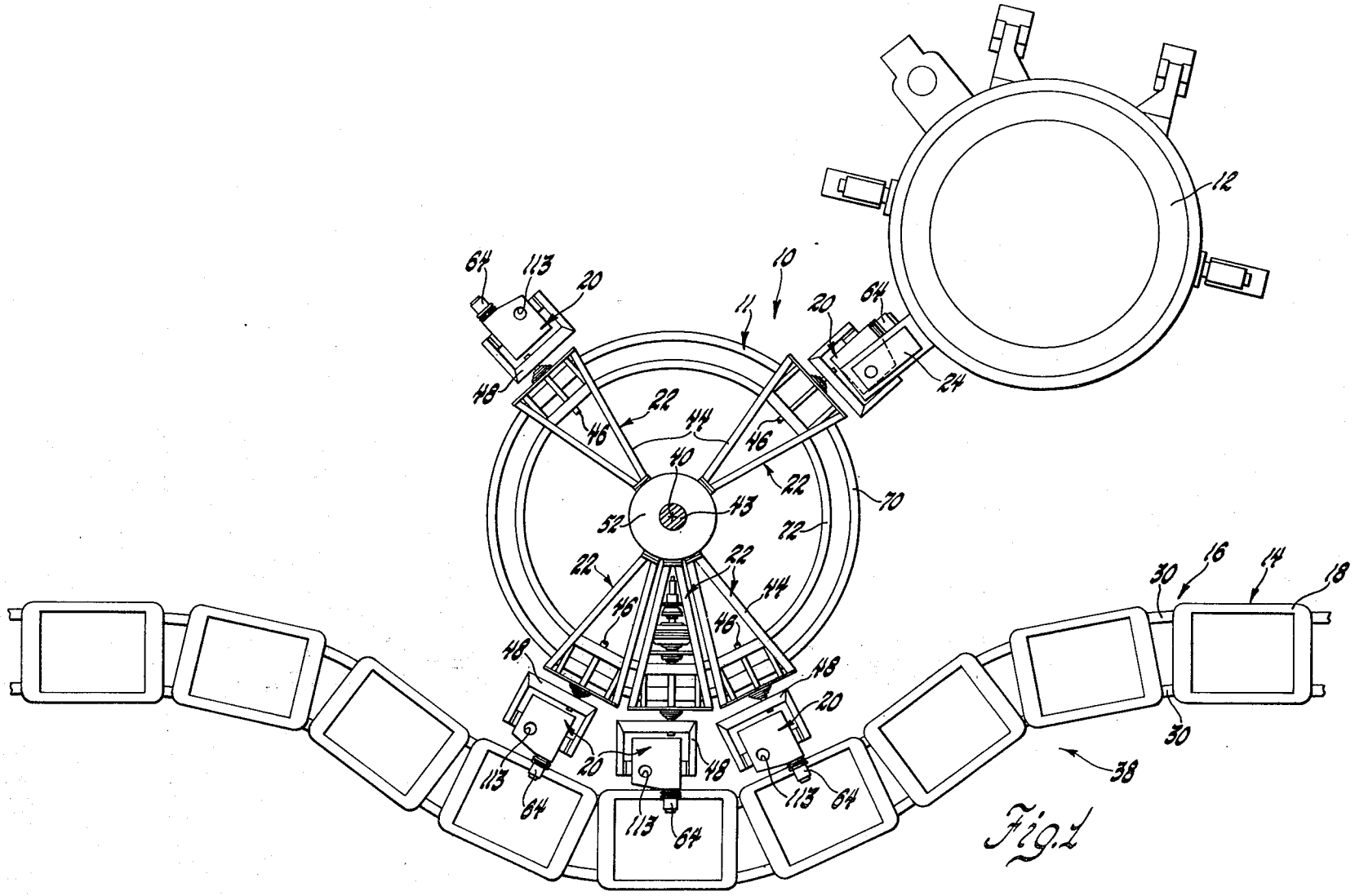
FIG. 1 is a plan view of one embodiment of a continuous mechanical iron pouring line showing the pouring carriages coupled to a center post, the holding vessel, and the mold conveyor link.

Referring to FIG. 1, there is shown a continuous mechanical iron pouring line made in accordance with the present invention incorporating a mechanical iron pourer 10 operative along a circular track 11. Each ladle 20 of the iron pourer 10 receives a metered supply of molten iron from a holding vessel 12 at a filling station and transfers the molten iron to a series of abutting sand molds 14 continuously traveling along a mold conveyor line 16 on mold carriages 18. The mold carriages abut one another or are otherwise spaced so that the molds 14 are substantially equally spaced one from the other along the conveyor line. The molds 14 are filled with ladles 20 rotatably supported on five independently driven pouring carriages 22.

The holding vessel 12 is conventional in construction. It receives a supply of molten metal from a furnace and dispenses it into the ladles 20 through a projecting pouring spout 24. Flow of the iron from pouring spout 24 is controlled in any suitable manner such as by a slide gate or a stopper rod. The liquid iron volume may be metered into the ladles 20 by means of a compensation timer or a float in the pouring spout of the holding vessel 12. The amount of iron is sufficient for a single mold.

As hereinafter described, the metered amount of iron is poured from the holding vessel 12 into the individual ladles 20. THe ladle 20 and associated carriage 22 are then driven under their own power along the circular track 11 into registry with a mold 14, locked onto the associated mold 14 or mold carriage 18, and driven along thereby through a pouring station. After traversing the pouring station, the ladle 20 and carriage 22 independently return to the filling station for refilling.

Figure 2:
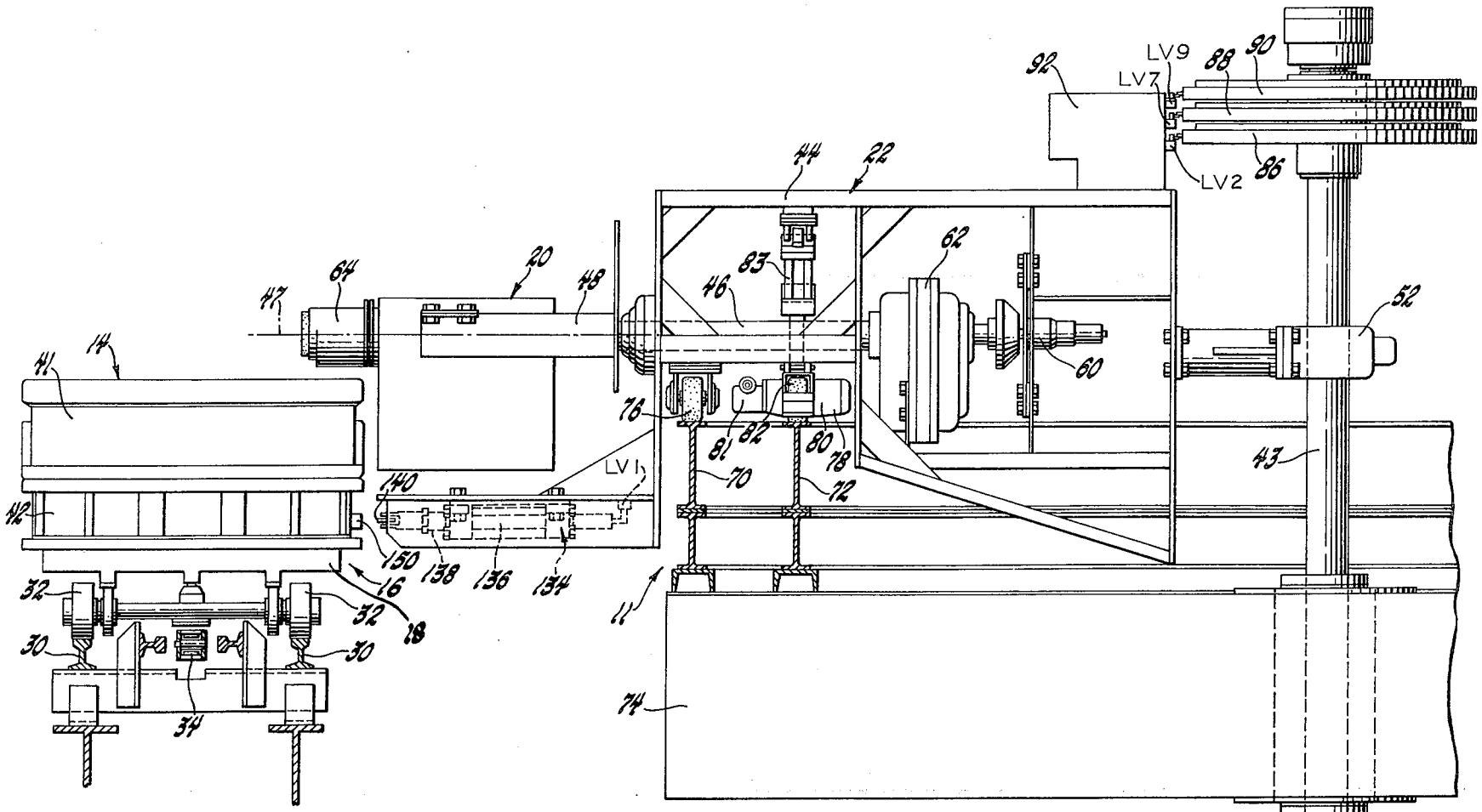
FIG. 2 is a side elevational view of the pouring line of FIG. 1 showing the ladle and carriage of the pouring station.

Referring to FIG. 2, the mold conveyor line 16 comprises a pair of spaced tracks 30. The mold carriages 18 are supported on the tracks 30 by a pair of wheels 32 and driven along the tracks 30 by a conveyor chain 34. The mold conveyor line 16 includes an arcuate sector 38 which is coaxial with the vertical axis 40 of the iron pourer 10. Throughout the sector 38, mold travel is parallel to and concentric with the travel of the individual pouring carriages 22. The mold conveyor system is conventional in construction and many other systems providing controlled movement of equispaced molds along a conveyor path would be equally adaptable with the present invention. Likewise, the molds are of a conventional construction being of the sand type or any other suitable type. Each mold 14 comprises a cope flask 41 and a drag flask 42. The flasks are filled with sand and define one or more cavities in the form of the objects to be cast.

The iron pourer 10 comprises the aforementioned five pouring carriages 22 and associated ladles 20 — though as few as two carriages/ladles make an effective system. As indicated, the carriages are independently movable, in carousel fashion, about a center post 43 defining the vertical axis 40. Each carriage 22 comprises a generally wedge-shaped frame 44 having an inner hub 52 rotatably journalled on the center post 43. The frame 44 diverges radially outwardly and supports the ladle 20 at its outer end for rotational movement by a drive shaft 46 about a horizontal axis 47 extending radially outwardly from the vertical axis 40. The ladle 20 is fixedly supported on a U-shaped yoke 48 fixedly connected at the outboard end of the drive shaft 46. The drive shaft 46 is operatively connected to a variable speed air motor 60 by means of a speed reducer 62. When the motor 60 is actuated as hereinafter described, the ladle 20 rotates clockwise as viewed from the front to dispense molten iron out of a horizontally and radially extending pouring nozzle 64.

The carousel track 11 comprises an outer circular lead track 70 and an inner circular drive track 72. Both tracks 70 and 72 are supported on a circular support base 74 fixed to the foundry floor. Each carriage 22 includes a pair of circumferentially spaced load wheels 76 which engage the top surface of the load track 70. Each carriage 22 has its own independent pneumatic drive means 78 comprising a variable speed air motor 80, a speed reducer 81, and a drive wheel 82. The drive means 78 are retractable from the drive track 72 by a two-way pneumatic cylinder 83 so as to deactivate the drive means by lifting the drive wheel 82 from the track 72 and reactivating the drive means by placing the drive wheel back onto the track. The drive means 78 are further controlled in accordance with the system hereinafter described.

Figure 8:
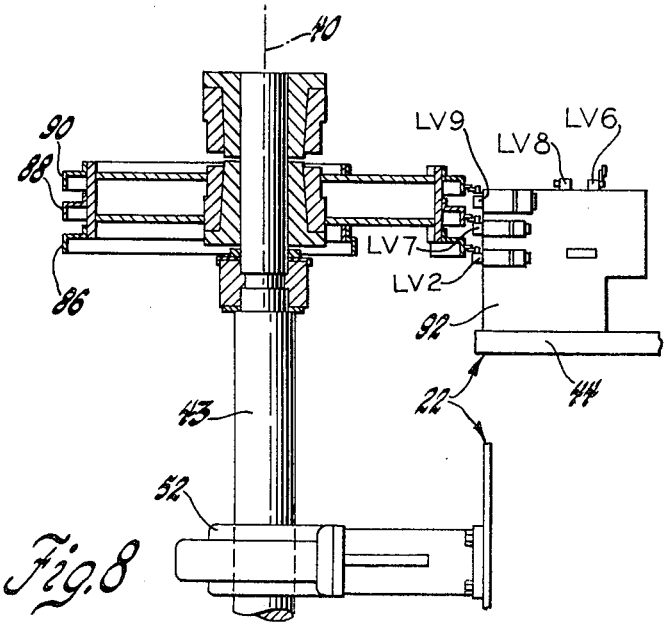
FIG. 8 is a cross sectional view showing the disposition of the control panel with respect to the control cams on the center post.

The center post 43 is carried by the support base 74 and projects vertically upwardly therefrom. The individual hubs 52 of the carriages 22 are rotatably journalled on the post 43 in vertically stacked relationship. Three control cams 86, 88 and 90 are fixedly mounted at the upper end of the center post 43. A control panel 92 on the inboard top surface of the frame 44 includes a first on-off valve LV2 which is operatively engaged by the lower control or low speed cam 86. A second on-off valve LV7 is operatively engaged by the intermediate control of high speed cam 88, and a third on-off valve LV9 which is operatively engaged by the upper control or pouring cam 90. Each control cam is contoured such that the associated valve is operated in accordance with the profiles thereof. The control panel 92, as shown in FIG. 8, additionally includes a fourth on-off valve LV6 which is operative when the ladle is in the proper position at the filling station and a fifth on-off valve LV8 which is operative when the ladle has been filled. These are in operative engagement at the furnace for actuation. Additionally, as shown in FIG. 6, each carriage 22 includes an on-off valve LV11 which engages a following carriage 22′ to sense the presence of a trailing ladle and an on-off valve LV4 which engages a preceding carriage 22″ to sense the presence of a leading carriage.

Figure 6:
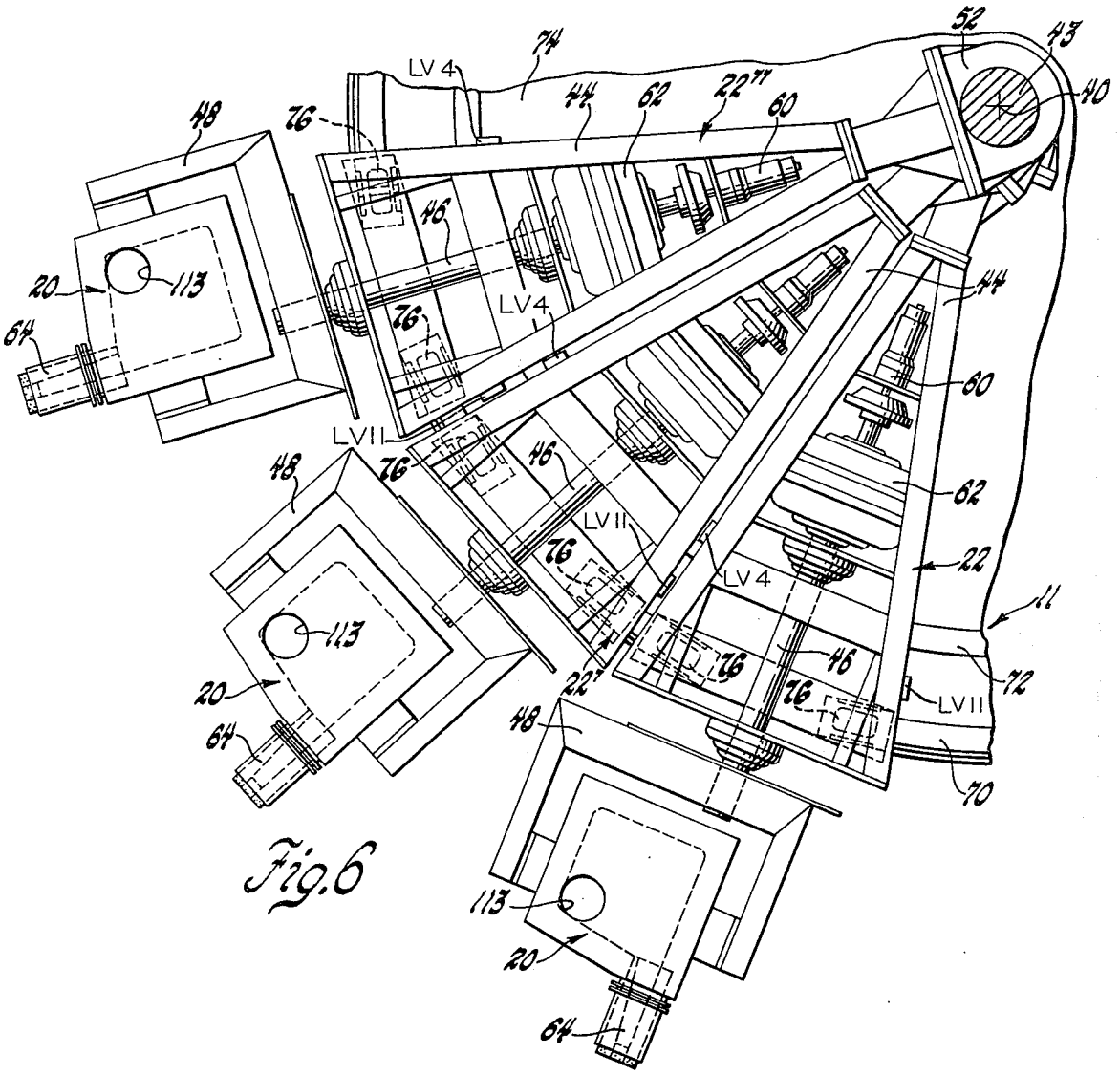
FIG. 6 is a partial enlarged top view of the iron pourer showing ladles and carriages in abutting relationship.
Figure 7:
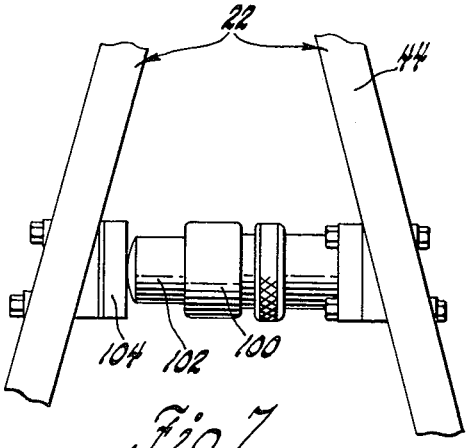
FIG. 7 is a fragmentary top view of the shock absorber between adjacent pouring carriages.

Referring to FIG. 7, each carriage 22 is provided with a shock absorber and abutment assembly located above the support wheels 76 (not shown on FIG. 6) for cushioning the impact forces as one carriage engages the preceding carriage primarily at the pouring station but also at the fill station if necessary. More particularly, the lead side of the carriage 22 is provided with a shock absorber 100 having a projecting piston 102 which engages an abutment plate 104 fixed to the trailing side of the preceding carriage. Upon impact, the piston 102 deflects within the shock absorber 100 to absorb the energy of impact.

Figure 3:
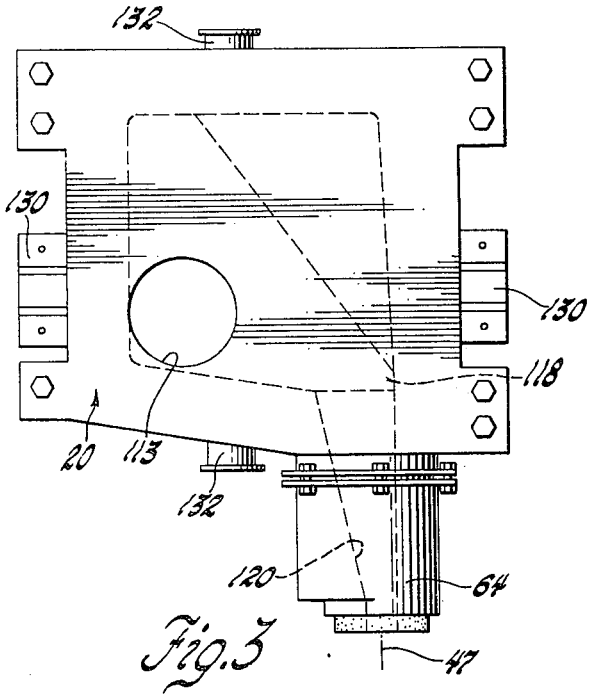
FIG. 3 is a top view of the pouring ladle.
Figure 4:
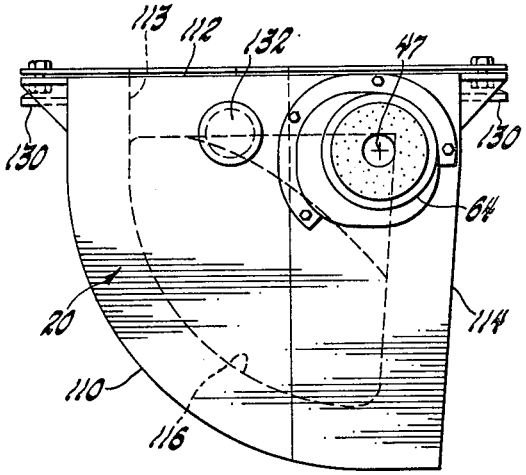
FIG. 4 is a front view of the pouring ladle.

Referring to FIGS. 3, 4 and 6, the ladle 20 is generally in the form of a quadrant of a cylinder having a cylindrical sidewall 110, a horizontal upper wall 112 having an opening 113 for receiving molten iron from the holding vessel 12, and a substantially vertical end wall 114. The walls define an iron holding cavity 116 having an end section 118 communicating with a horizontally disposed pouring opening 120 in the pouring nozzle 64. The opening 120 is coaxial with the horizontal axis 47. In the illustrated iron carrying position, the molten iron has a liquid level below the nozzle 64. As the ladle 20 is rotated clockwise by drive shaft 46, molten iron is discharged through the pouring opening 120 as the liquid level rises thereabove. The ladle 20 is adapted to rotate 120° such that the entire cavity 116 is above the level of the pouring opening 120. The ladle 20 is fixedly connected at side lugs 130 to the side arms of the yoke 48. The ladle includes lifting lugs 132 for permitting removal of the ladle for repair and maintenance.

Figure 5:
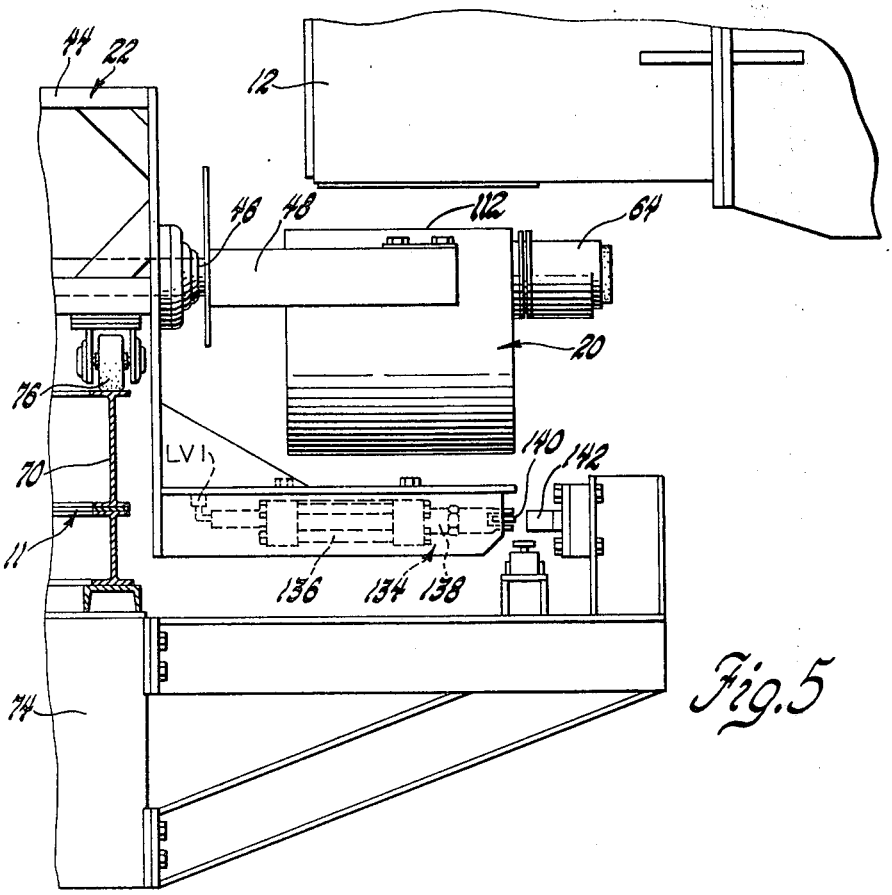
FIG. 5 is a partial side elevational view showing the ladle and carriage at the filling station.

Referring to FIGS. 2 and 5, the front end of the carriage 22 below the ladle 20 is provided with locating and locking means 134 for locking the carriage at the filling station and the pouring station. The locking means 134 comprises a pneumatic cylinder 136 having an extendable piston 138 including a locking dog 140. When the ladle is at the filling station as shown in FIG. 5, the piston 138 is extended and the locking dog 140 engages a catch 142 located at the filling station to hold the opening 113 of the ladle 20 in alignment with the discharge nozzle of the holding vessel 12. Similarly, (see FIG. 2) when the ladle is properly indexed with respect to a leading carriage and an associated mold at the pouring station, the piston 138 extends and the locking dog 140 engages a catch 150 on the drag flask 42, or carriage 18, to lock the pouring carriage 22 onto the mold conveyor line. At this time, the pouring nozzle 64 is located and maintained in registry with the sprue on the mold for proper discharge of molten iron into the mold cavity while traversing the pouring station. An on-off valve LV1 is associated with the cylinder 136 and is released as the piston 138 is extended to effect the lifting off of the driving means 78 from the track 72 by the cylinder 83 and subsequent cutting off of air to the drive motor.

The ladle 20 operatively includes on-off valves LV3 and LV10 (not shown) which respectively sense when the ladle is at the 0° (i.e., iron-carrying) position or 120° (i.e., iron-pouring position).

OPERATIONAL MODES

Figures 9, 10:
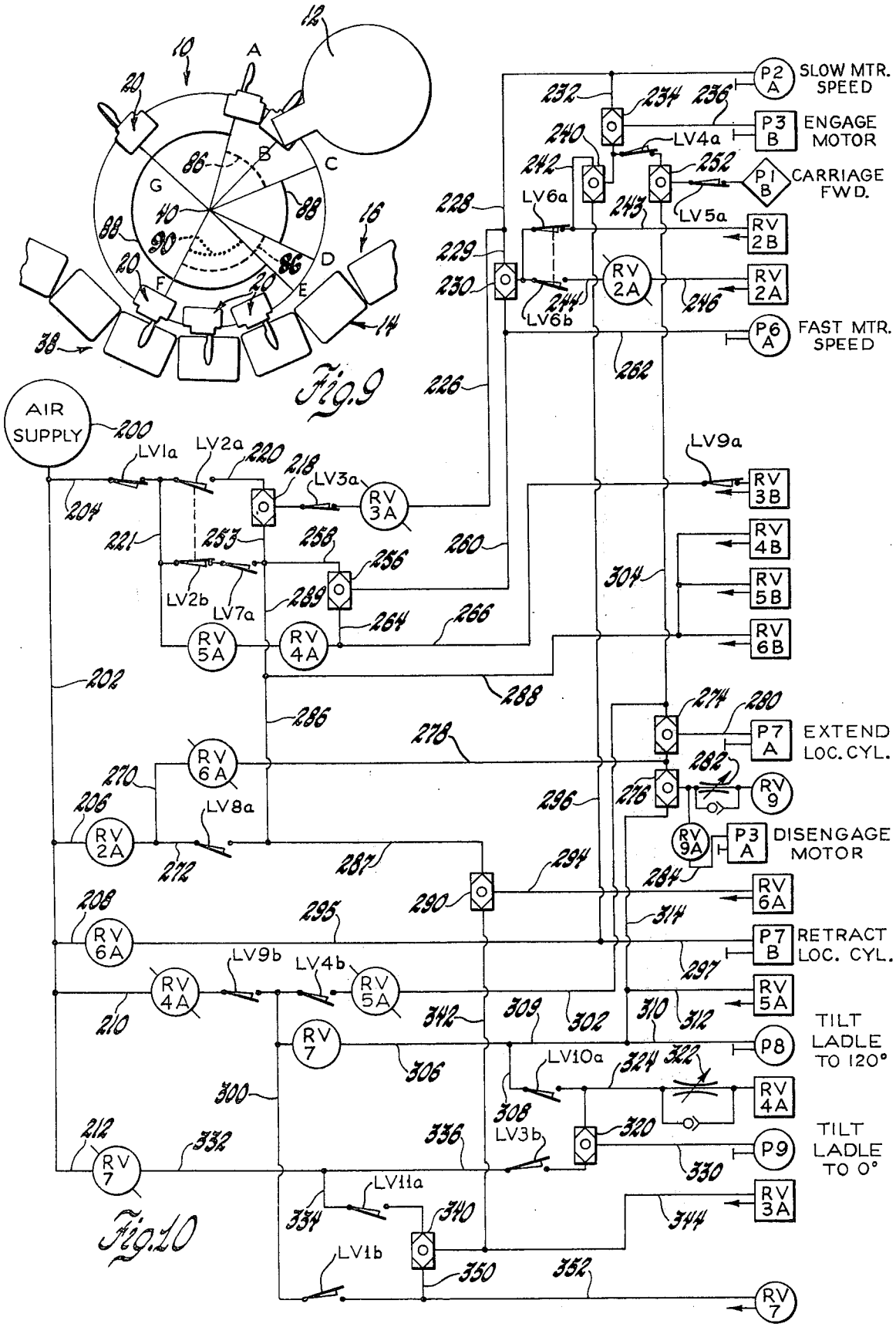
FIG. 9 is a schematic view of the operational sectors between the iron pourer, the holding vessel, and the mold conveyor line.
FIG. 10 is a schematic diagram of the control system (using NFPA standard limit value symbols) for one embodiment of the mechanical iron pourer.

Referring to FIG. 9, the iron pourer 10 includes distinct operating modes indicated as sectors AB, BC, CD, DE, EF and FA. FIG. 9 also depicts the operative sectors of the slow speed cam 86, the high speed cam 88 and the pouring cam 90 carried on the center post 43. The slow speed cam 86 indicated by the dashed lines subtends a first sector from A through C and a second sector from D through F. The fast speed cam 88 indicated by the solid lines spans a first sector from C through D and a second sector from E through A. The pouring cam 90 indicated by the dotted lines is an "OK to Pour" safety device spanning a sector from E to F to insure that the ladle cannot accidentally be poured except in that sector. In the sector AB, the slow speed cam 86 actuates the valve LV2 which, acting in concert with the rest of the pneumatic circuit, provides a "slow advance to fill" mode in which the drive motor 80 is slowed to advance the carriage slowly (e.g., at about 30 feet per minute) into the filling station at B. At location B, ladle 20 is filled from vessel 12. The sector BC defines a "slow advance from fill" mode wherein, after filling, the carriage is driven at a slow motor speed from the filling station. In the sector CD, the high speed cam 88 actuates the valve LV7 which, acting in concert with the rest of the pneumatic circuit, provides a "fast advance toward pouring station" mode wherein the carriage is driven at a fast (e.g., about 90 feet per minute) speed rapidly toward the pouring station. In the sector DE, the slow speed cam 86 activates the valve LV2 which, acting in concert with the rest of the pneumatic circuit, provides a "slow advance to pouring station" mode wherein the carriage decelerates to the slow motor speed and advances slowly into the pouring station. After location E, the entering carriage 22 engages the preceding carriages and triggers the extension of the entering carriage's locator 136 to register the entering carriage's ladle with its associated mold which is also advancing into the pouring station. The sector EF spanned by the "OK to Pour" cam 90 defines the traveling "pouring station" wherein the carriage which has been coupled to an associated mold is maintained in registry therewith and its ladle poured. In the sector FA, the high speed cam 88 acting on the valve LV7 provides a "fast advance from pouring" mode wherein after pouring has been completed the carriage is driven at the fast motor speed back to the filling station for refilling.

CONTROL SYSTEM

The control system for the subject mechanical iron pouring line is shown in FIG. 10. Therein, air from a suitable supply such as a pump 200 is supplied from main line 202 to branch lines 204, 206, 208, 210 and 212. On-off valve LV1 is a two-passage on-off valve having a first passage LV1*a* conductive through line 204 when locking cylinder 138 is retracted. On-off valve LV2 is a two-passage on-off valve having a first passage LV2*a* conductive with passage LV1*a* when the cam 86 actuates valve LV2 in sectors AC and DEF. LV2*a* is connected to a shuttle valve 218 via line 220. Passage LV2*a* is connected in parallel circuit with line 221 with a normally conductive passage LV2*b* of valve LV2 and the normally non-conductive passage LV7*a* of a single passage on-off valve LV7. Passage LV2a is connected in another parallel circuit with a two-position four-way relay valve RV5 having a normally non-conductive passage at line 221. A two-position four-way relay valve RV4 has a normally non-conductive passage serially connected with passage RV5A. The shuttle valve 218 is serially connected with a passage LV3*a* of a two-way on-off control valve LV3 which is actuated when the ladle is in the 0° position. A passage RV3A of the two-way two-position relay valve RV3 is conductive with passage LV3*a*. A line 226 leading from passage RV3A is connected with lines 228 and 229. Line 228 leads to a pressure control valve P2A operative to drive the air motor at the slow motor speed when pressurized. Line 229 leads to a shuttle valve 230. The line 228 has a branch line 232 leading to a shuttle valve 234. The shuttle valve 234 is ported along line 236 to a pressure control valve P3B. This is operative to extend cylinder 83 to engage drive wheel 82 with drive track 72. The shuttle valve 230 is connected with a normally conductive passage LV6a and a normally non-conductive passage LV6*b* of a two-way on-off valve LV6. Valve LV6 is actuated when the ladle is at the filling station. Passage LV6*a* is connected with shuttle valve 240 along line 242 and with the B pilot of relay valve RV2 along line 243. The passage LV6*b* of valve LV6 is connected in series with normally conductive passage RV2A of two-position four-way relay valve RV2 along line 244. Passage RV2A is connected along line 246 to the A pilot of the relay valve RV2. Shuttle valve 240 is connected with shuttle valve 234 and a normally conductive passage LV4*a* of on-off valve LV4. Valve LV4 is actuated when a preceding ladle is sensed. Passage LV4*a* connected with shuttle valve 252. Shuttle valve 252 is ported to a normally non-conductive passage LV5*a* of on-off valve LV5. Valve LV5 is actuated when the drive motor is engaged. Passage LV5*a* is connected with a carriage directional control pilot P1B at the drive motor.

Valve passage LV7a is connected with line 253 and with shuttle valve 256 along line 258. Shuttle valve 256 is ported along line 260. Line 260 is connected with shuttle valve 230 and with control valve P6A along line 262. Valve P6A when pressurized applies the fast speed flow control to the drive motor. One valve passage of RV4A is connected with shuttle valve 256 along line 264 and with passage LV9*a* of two-way on-off valve LV9 along line 266. Valve LV9 is actuated when the ladle is at the pouring station. Passage LV9*a* is connected to the B pilot of a two-position four-way relay valv RV3.

Branch passage 206 is connected to passage RV2A of relay valve RV2. RV2A is connected with lines 270 and 272. Line 270 is connected in series with a passage RV6A of a two-position four-way relay valve RV6 which is connected with shuttle valves 274 and 276 along line 278. Shuttle valve 274 is ported along line 280 to the A pilot of control valve P7A which is operative to extend locating cylinder for locating and locking engagement at either the filling station or the pouring station. Valve 276 is connected with a two-way two-position relay valve RV9 by a delay timing circuit 282 and with a normally non-conductive passage RV9A of valve RV9. The passage RV9A is connected along a line 284 with the A pilot of the two-way control valve P3 which is operative to retract the cylinder 83 to disengage the drive wheel 82 when pressurized. A normally non-conductive passage LV8a of two-way valve LV8 is connected with lines 286 and 287. Valve LV8 is momentarily actuated when the ladle is filled. Line 286 has parallel branch lines 288 and 289. Line 288 is connected with the B pilots of relay valves RV4, RV5 and RV6. Line 289 is connected to line 253 leading to shuttle valve 218 and line 258 leading to shuttle valve 256. Line 287 leads to shuttle valve 290 which is ported to the A pilot of relay valve RV6 along line 294.

A passage RV6A of the relay valve RV6 is connected to branch line 208. This passage is connected along line 295 with branch lines 296 and 297. Line 296 is fluidly connected with the shuttle valve 240. Line 297 is connected to the B pilot of control valve P7 and is operative to retract the locating cylinder.

A passage RV4A of a two-position four-way relay valve RV4 is connected to branch line 210. This passage is serially connected with a normally non-conductive passage LV9*b* of on-off valve LV9. Passage LV9*b* is connected with a normally non-conductive passage LV4*b* of valve LV4 and with line 300. Valve LV9 is controlled by cam 90. A passage RV5A of two-position four-way relay valve RV5 is connected to passage LV4*b* and is conductive whe the B pilot is pressurized. Passage RV5A is connected along line 302 with valve 274 and with valve 252 along branch line 304. One passage of two-position four-way relay valve RV7 is connected to line 300 and line 306 to branch lines 308 and 309. Line 309 is connected to lines 310, 312 and 314. Line 310 is connected to control valve P8 for energizing motor 60 to tilt the ladle to 120° when pressurized. Line 312 is connected with the A pilot of relay valve RV5A. Line 314 is connected to shuttle valve 276.

A passage LV10*a* of on-off valve LV10 is connected to line 308 and is actuated when the ladle is at the 120° pouring position. Passage LV10*a* is connected with shuttle valve 320 and along line 324 with time delay switch 322. Switch 322 is connected to the A pilot of two-position, four-way valve RV4. The shuttle valve 320 is ported along line 330 to the control valve P9 which is operative to reversely energize motor 60 to tilt the ladle from 120° to 0°.

Another passage of valve RV7, conductive when the B pilot is pressurized, is connected to branch line 212. This passage of RV7 is connected along line 332 to parallel lines 334 and 336. Line 336 is connected to a passage LV3*b* of on-off valve LV3. Passage LV3*b* is connected to shuttle valve 320. Line 334 is connected to a normally non-conductive passage LV11a of on-off valve LV11. Valve LV11 is actuated when a trailing ladle is sensed. Passage LV11*a* is connected to shuttle valve 340. Shuttle valve 340 is ported along branch lines 342 and 344 to shuttle valve 290 and the A pilot of relay valve RV3, respectively. A normally non-conductive passage LV1*b* of on-off valve LV1 is connected to line 300. Passage LV1*b* is connected to lines 350 and 352 with shuttle valve 340 and the pilot of relay valve RV7, respectively.

OPERATION

SLOW RETURN TO FILL

In the "slow advance to fill" operational mode through sector AB, the carriage 22 and associated ladle 20 decelerate from the fast motor speed and, at the slow motor speed, advance to the filling station B until such time as the opening 113 in the ladle 20 registers with the pouring spout in the holding vessel 12. In this position passages LV1*a*, LV2*a*, LV3*a*, LV4*a*, LV5*a*, LV6*a*, and LV9*a* are conductive to pressurize the associated lines. Passages LV2*b*, LV3*b*, LV4*b*, LV6*b*, LV7*a*, LV8*a*, LV9*b*, LV10*a*, and LV11*a* are non-conductive. Air from supply 200 pressurizes control switch P2A which is operative to impose the slow motor speed control on the carriage drive motor while maintaining an engaged motor circuit through valve 234 to the engage motor pressure control switch P3B. A parallel circuit is completed to control pilot P1B to maintain carriage directional control. The remaining circuits are rendered non-conductive by the associated relay valves and on-off valves.

Accordingly, the carriage is driven at the slow speed, and the ladle 20 advances slowly to filling station B.

FILLING STATION

At position B, valve LV6 is actuated to close (i.e., make non-conductive) passage LV6*a* and open (i.e., make conductive) passage LV6*b*.

This interrupts the circuit to the carriage directional control pilot P1B. A parallel circuit is completed from valve 230 through valve passage LV6*b* and normally closed valve passage RV2a at line 244 to energize the A pilot RV2A of relay valve RV2. This shifts the valve RV2 to the A position closing the passage RV2A, at line 244 interrupting pressure to the pilot and opening the normally non-conductive passage RV2A at line 206. Accordingly, pressure is conducted through branch line 270, relay valve passage RV6A, line 278, valve 274, and line 280 to pressurize pressure control valve pilot P7A which is then operative to extend the locating cylinder 136 and lock the carriage to the fill machine. When the locating cylinder 136 is fully extended, valve LV1 is actuated to close passage LV1*a* and open passage LV1*b*. This removes power control from the motor by interrupting pressure to P2A. Simultaneously therewith, a parallel circuit is completed through valve 276 to the time delay switch 282 which is operative after a time delay to pressurize relay valve RV9 to open passage RV9A so as to pressurize control valve P3A and disengage the drive motor from the drive track. This in turn disengages the drive carriage directional control by opening valve passage LV5*a*. Concurrently therewith, the holding vessel through separate controls starts to fill the ladle with molten iron.

When the ladle is filled, valve passage LV8a is rendered momentarily conductive. This completes a circuit to the B pilots of relay valves RV4, RV5, and RV6. This closes the passage of RV6A at branch 270 and opens the passage of RV6A at branch 208 thereby directing fluid to the B pilot of control valve P7. This is operative to retract the locating cylinder 136. Pressure is also conducted through line 296, valve 240, valve 234 and line 236 to pressurize control valve P3B which engages the carriage drive wheel 82 as cylinder 83 extends to actuate valve LV5 and open passage LV5*a*. In a parallel circuit through passage LV4*a*, valve 252 and passage LV5*a*, power control valve P1B is pressurized to provide directional control to the drive motor.

SLOW ADVANCE FROM FILLING STATION

As the locating cylinder retracts, the passage LV1a is opened and the slow motor speed control circuit is completed as above described to P2A.

As the carriage leaves the fill station passage LV6a opens and passage LV6*b* closes. This maintains directional control to the carriage and the carriage advances slowly toward position C.

FAST ADVANCE TO POURING STATION

When the carriage reaches position C, the fast speed cam 88 actuates valve LV7 while valve LV2 is deactivated by the slow speed cam. This closes passage LV2*a* and opens passage LV2*b*. This completes a circuit through passages LV1*a*, LV2*b*, LV7*a*, valve 256, lines 260, 262 to the fast motor speed power control valve P6A. A circuit is completed through valve 230, passage LV6*a*, valves 242, 234 to P3B to maintain motor engagement and through LV4*a*, 252, and LV5*a* to P1B to maintain carriage directional control.

The drive motor then advances the carriage and ladle at the high motor speed from pilot C to point D on the carriage track.

SLOW ADVANCE TO POURING STATION

As the carriage and ladle enters sector DE, the fast speed cam 88 closes passage LV7*a* and the slow speed cam opens passage LV2*a* and closes LV2*b*. This drives the carriage at a slow speed to the pouring station in the same manner as described with reference to the travel through sector BC from the filling station. In particular, a fluid circuit is completed through LV1*a*, LV2*a*, 218, LV3*a*, RV3*a* to P2A for the slow speed motor control. Parallel circuits are completed through valve 234 to P3B and through valves 230, LV6*a*, 240, LV4*a*, 252, LV5 to the carriage directional control P1B. The B pilot of valve RV2 is pressurized to close passage RV2*a* at line 206.

POURING STATION MODE

When the carriage reaches point E, the "ready to pour" cam 90 actuates valve LV9 which indicates that the ladle is in a position to commence pouring. Thereafter the carriage continues to advance at the slow motor speed until it contacts the ladle and carriage ahead in the pouring sector of the carousel. This actuates "ladle ahead" valve LV4 which closes passage LV4*a* and opens passage LV4*b*. Accordingly, a fluid circuit is completed through line 210, passages RV4*a*, LV9*b*, LV4*b*, RV5*a*, valve 274, line 280 to valve P7A. This extends the locating cylinder 136 to lock the carriage to the drag mold 42. When the locating cylinder is fully extended it closes passage LV1*a* and opens passage LV1*b*. It also disengages the motor as noted hereinafter in conjunction with the actuation of P3A. The closing of LV1*a* interrupts the fluid line to the motor thereby removing directional control therefrom. Concurrently therewith, a parallel branch circuit is completed to valve RV7 through line 300, passage LV1*b* and line 352 to pressurize valve RV7. This open passage RV7*a* at line 306 to conduct pilot P8 which starts tilting the ladle to the 120° position. Also branch circuits are completed through line 312 to A pilot of valve RV5 thereby opening passage RV5*a* at branch 221, and through line 314 and valve 276 to time delay 282 and relay valve RV9A. Opening RV9A in 284 actuates P3A and disengages the motor.

When the ladle reaches 120° position, valve passage LV10*a* is opened. This completes a fluid circuit through line 308, LV10*a*, line 324 to the timing switch 332 and to RV4*a*. Concurrently, a fluid circuit is completed to valve 320, line 330 to motor control valve P9. After the timing cycle has been completed, valve pilot RV4A is energized at line 210 thereby interrupting the circuit to the motor control valve P8. Concurrently, a line through valve passage RV7*b* at line 212 is completed through lines 332, 336, LV3*b*, valve 320, line 330 to pressure control valve P9 which is operative to reverse ladle motor 60 and commence returning the ladle to the 0° position. If there is now a ladle behind the reference carriage, passage LV11a will be opened to complete a fluid line through line 334, LV11*a*, valve 340, line 344 to energize valve RV3*a* at line 226. Concurrently, pressure will be delivered through line 342, valve 290, line 294 and RV6A at line 208 to energize B pilot of pilot valve P7B which will then retract the locating cylinder. This will close valve LV1*b* and open LV1*a* which causes the high speed, forward direction and motor engagement circuit (i.e., valves P6A, p1B and P3*b*, respectively) to be energized. The carriage will then be driven at fast motor speed through sectors FG and GA. As the carriage leaves the pouring station valve LV9 will be actuated. At point A, LV7*a* is closed and LV2*a* is open. If the ladle is not returned to the 0° fill position when the carriage reaches point A, LV3*a* will open and the motor will disengage until the ladle is level. When the ladle is level the fluid circuit for the slow mode will be completed and the ladle and carriage will be driven up the slow motor speed to the fill station for filling and continuation of the pouring cycle as above described.

The above-described control system whether through the use of the pneumatics described above or through electrical circuitry and appropriate motors will provide the independent carriage travel from a filling station to a moving conveyor line, the subsequent sequencing and pouring in accordance with the movement of mold line, and after completion of the pouring cycle independent rapid return to the filling station. Inasmuch as each carriage is independent from the others subject only to the "ladle behind" and "ladle ahead" control system, an individual carriage may be removed from the carousel for repair and servicing. Additionally, if manual overrides are desired for the pouring machine the same may be readily incorporated into the subject system. Moreover, in preferred systems directional controls are provided to permit manually reversing the direction of each air drive motor to facilitate maintenance, etc.

FIGS. 11 – 15 show another embodiment of the invention in which the independently driven and self-controlled ladle carriages travel a closed-loop path, as before, but are not centered or dependent on a fixed axis or vertical post such as 40 and 43 respectively in the embodiment described with reference to FIGS. 1 – 10. Moreover, the embodiment of FIGS. 11 – 15 employs a much simpler ladle carriage drive system. In this regard, at the fill station, the drive means is deactivated by stalling the carriage to thereby stall the drive motor. At the pour station, the drive means is retarded by the braking action of the preceding carriage and coupling to the associated mold such that its rate of advancement is determined by the speed of the mold line to which the carriage is coupled.

Figure 11:
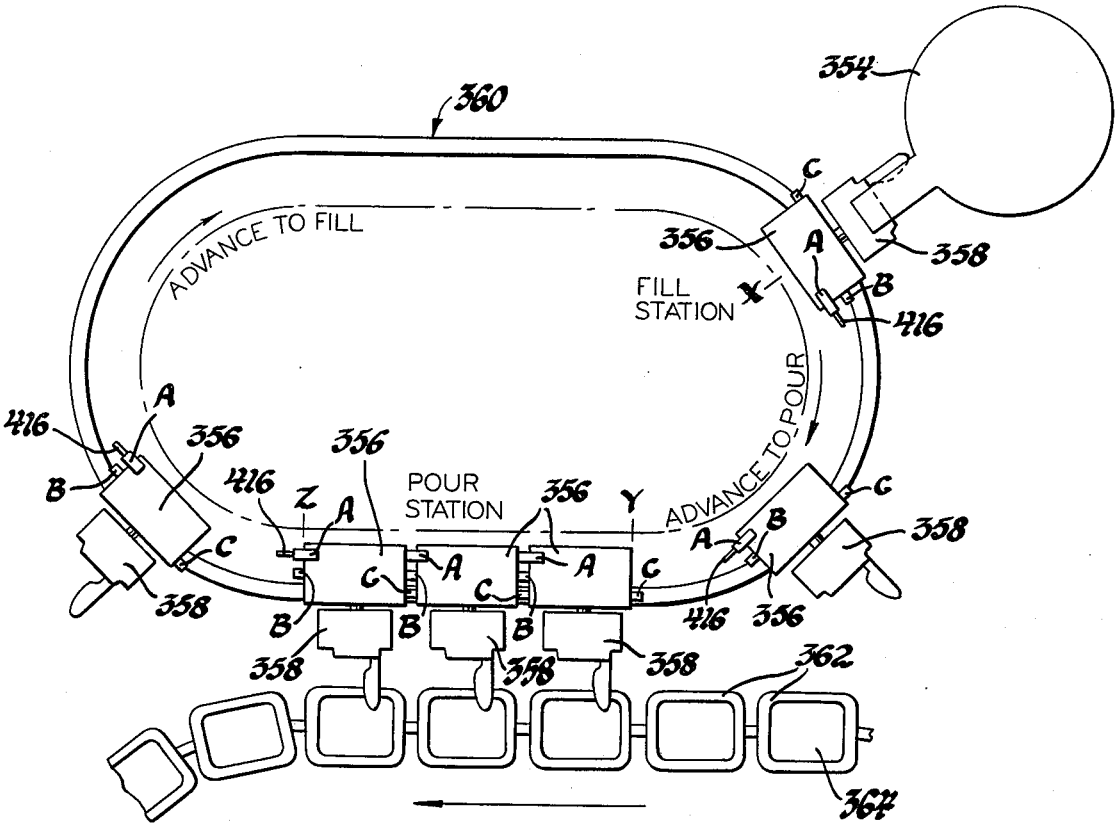
FIG. 11 is a schematic plan view of another embodiment of the mechanical iron pourer in which the carriage is not coupled to a center post.
Figure 13:
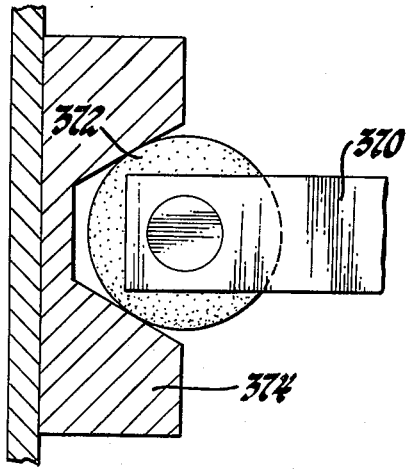
FIG. 13 is an enlarged top view of the mold locating means as seen in the direction 13—13 of FIG. 12.

FIG. 11 is a schematic plan view depicting: a molten metal holding and dispensing vessel 354; a plurality of carriages 356 carrying ladles 358 and on and off valves A, B and C; a closed loop oval course 360 traversed by the carriages and ladles; and a plurality of mold carriages 362 carrying molds 364 equispaced from each other along a mold conveyor 366.

Figure 12:
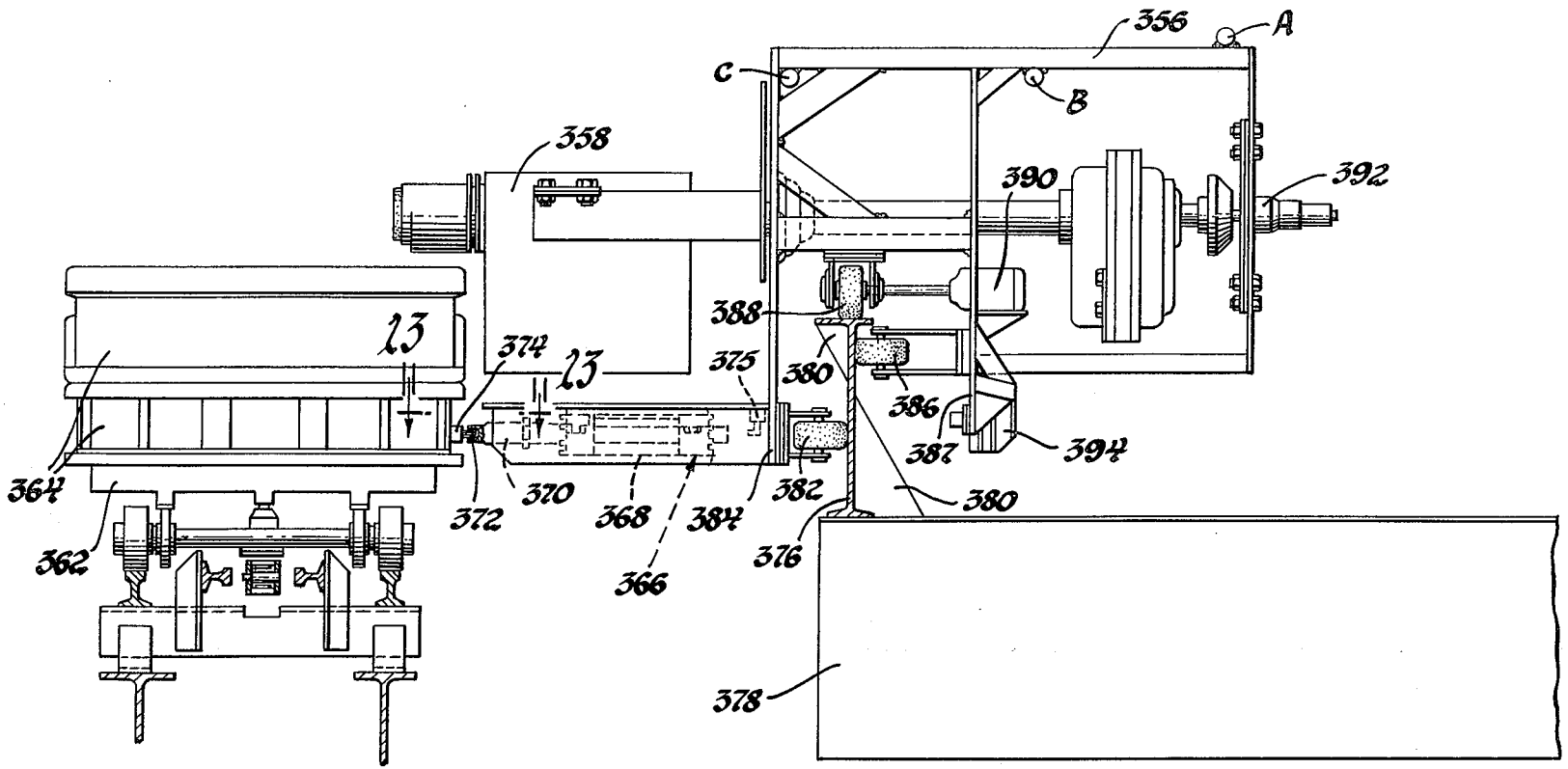
FIG. 12 is a side elevational view of a ladle and carriage at the pouring station at a non-center-post dependent mechanical iron pourer of the type illustrated in FIG. 11.

In a fashion and with structural elements similar to FIG. 2, FIG. 12 shows the ladle carriage 356 and ladle 358 located at the pouring station and just prior to commencing to filling the mold 364 (i.e., cope and drag flasks). For the sake of simplicity, structural elements common to those shown in FIG. 2 are not repeated here except as where may be necessary to facilitate the description of other elements. In FIG. 12, the locating and locking means 366 between the ladle carriage 356 and mold 364, or alternatively mold carriage 362, comprises a pneumatic cylinder 368 having an extendable piston 370 extended so as to have the locking dog 372 in locating/locking engagement (see FIG. 13) with the V-block or catch 374 on the mold 364, or mold carriage 362.

Unlike the embodiment shown in FIG. 2, the ladle carriage 356 is not journalled to a vertical center post (i.e., 43 in FIG. 2), but rather is supported on a solitary guide and drive track 376 mounted on the machine foundation 378. The track 376 is reinforced against bending or warping by webs 380 spaced along the track. Wheels 382 (only one shown) mounted on the outboard end frame member 384 of the carriage 356 and coacting wheels 386 (only one shown) mounted on the frame member 387 guide and stabilize the ladle-bearing carriages as they traverse the closed-loop path.

The drive means for the carriage 356 comprises a drive wheel 388 coupled to air drive motor 390 which is in turn appropriately coupled to an air source through control means (not shown) for varying the air flow to the motor 390 so as to vary the drive motor speed. In this embodiment, the drive wheel 388 remains in engagement with the track 376 at all times, and the drive motor 390 remains under pressure from the air source. Hence in the pouring station the drive wheel 388 continues to rotate under power from the motor 390 driving the carriage forward. However, since the carriage 356 has engaged a preceding carriage in the pour station and the locating and locking means 366 have linked the carriage to the mold conveyor the actual forward speed of the carriage is limited by the speed of the conveyor line. This partial braking of the carriage by the mold conveyor then merely retards the drive motor 390 without stalling it.

The pouring of the molten metal from the ladle is triggered in the same manner as in the embodiment of FIGS. 1 – 10. In this regard, a safety pouring cam (not shown) is located anywhere conveniently adjacent the pouring station to insure that the ladle does not prematurely pour outside the pouring station. An on-off valve (not shown) on the carriage 356 engages the pouring cam and permits activation of the ladle-pouring motor only in the pouring station. Upon entering the pouring station a control valve B on a leading edge of the entering carriage 356 engages the preceding carriage already in the pouring station and triggers the extension of the piston 370 to locate and lock the carriage 356 in registry with the mold 364 by means of dog 372 and catch 374. When this location and locking-up sequence is completed, on-off valve 375 is actuated to effect rotation of the ladle and metal pouring begins and continues as both ladle and mold move through the pouring station in the same manner as described in connection with the embodiment of FIGS. 1 – 10. Similarly after the ladle has poured its iron and when on-off valve C on a trailing edge of the carriage 356 senses the presence of a following carriage, the piston 370 is retracted and the carriage is released from the braking action of the mold conveyor. In the absence of a following carriage, the cylinder 370 is not retracted, the carriage bearing the empty ladle at the end of the pouring station is not released from the pouring station and the pouring line and mold conveyor line are automatically shut down. In this regard, it is important that a ladle carriage remains in the pouring station at all times to provide a mold registry reference for following carriages upon subsequent start-up. If released by a following carriage, the previously retarded drive motor 390 takes over and drives the carriage at high speed via drive wheel 388 from the pouring station back to the filling station for refill. In transit, the ladle 358 returns to the horizontal position and is ready for refilling.

When a succeeding ladle carriage has effected the release of a carriage and its emptied ladle, the emptied carriage moves at the high motor speed through the "advance to fill" sector ZX of the closed loop to the fill station beneath the holding and dispensing vessel 354

Figure 14:
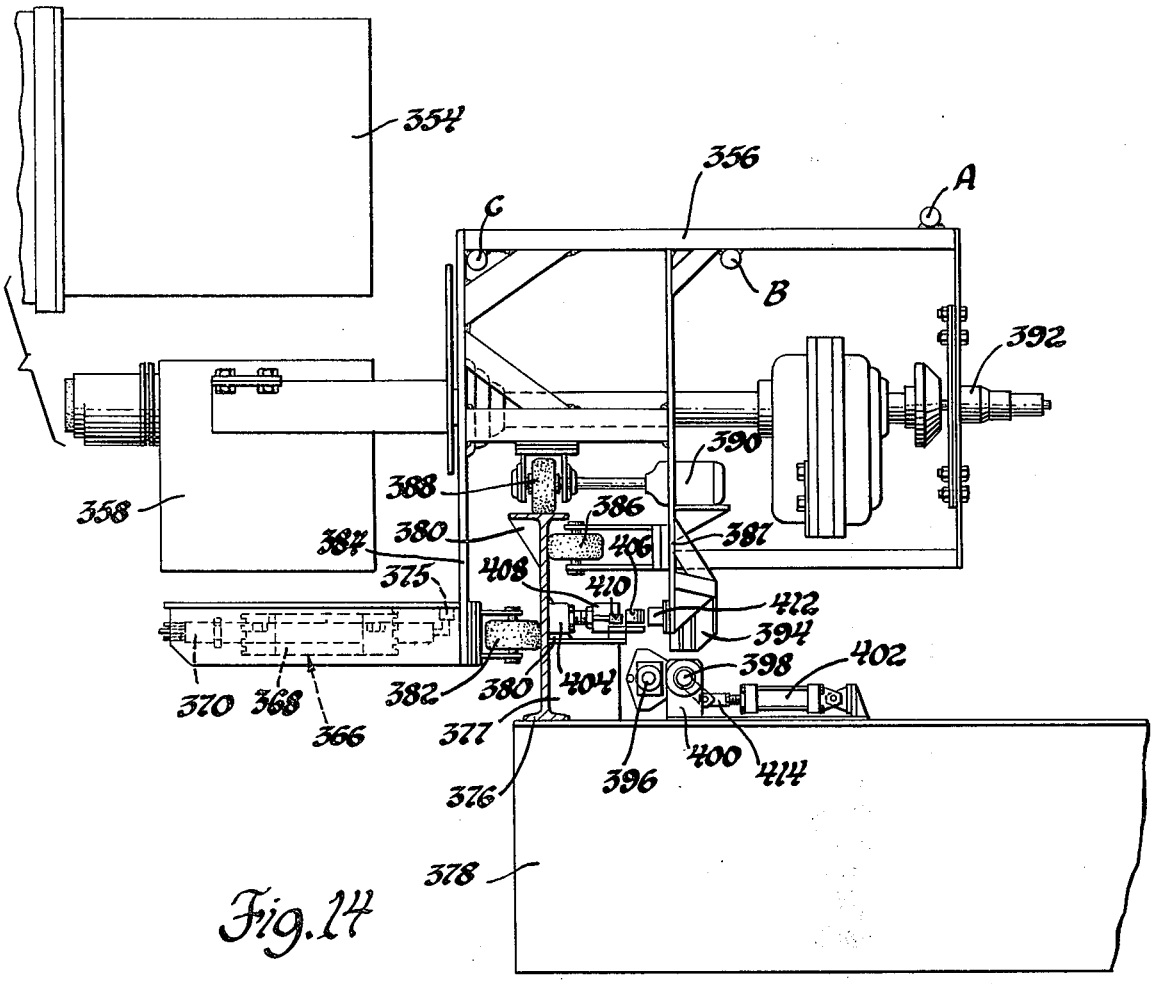
FIG. 14 is a side elevational view of a FIG. 12 type ladle and carriage at the filling station.
Figure 15:
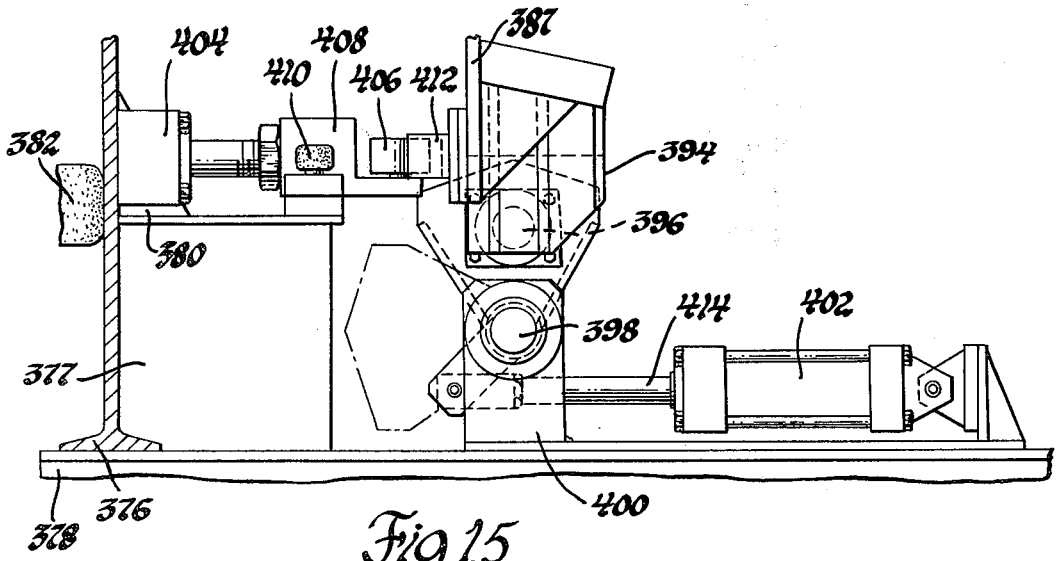
FIG. 15 is an enlarged view of the shock absorber and locating means for the carriage at the filling station.

(see FIG. 11). FIG. 14 shows the ladle 358 and ladle-carriage 356 just prior to stopping beneath the filling spout of the vessel 354. In this position, the cylinder 370 on the ladle-mold locating/locking means 366 is retracted as shown. A reinforced plate 394 depends from the bottom of the frame of the carriage 356. As the carriage 356 approaches the filling station a shock absorber and stop 396 is pivoted upwardly, by means of a pneumatic cylinder 402, about a shaft 398 carried in a yoke 400 anchored to the foundation 378 (see FIG. 15). The plate 394 on the approaching carriage 356 engages the shock absorber 396 and the carriage's forward motion stops as the motor 390 stalls at the point where the ladle is located to receive molten metal from the vessel 354. At substantially the same time a pneumatic cylinder 404, which is fixedly mounted on the track 376 and supported by the web 377, is actuated. The cylinder 404 is operatively associated with the locking dog 406 mounted on the L-shaped bracket 408 so that upon extension of the cylinder 404 the bracket slides between cooperating guide rollers 410 and forces the dog 406 into locking engagement with the V-groove catch 412 fixedly mounted to the frame of the carriage 356. With the ladle in the horizontal position of the aforesaid fill station locating/locking sequence completed, filling of the ladle 358 is accomplished.

Following completion of the filling cycle, the locking dog 406 and cylinder rod 414 are retracted. The shock absorber and stop 396 are pivoted out of engagement with the reinforced plate 394 and the carriage 356 is released. With the disengagement of the stop 396 and releasing of the motor stalling condition, the still pressurized air motor 390 drives the carriage 356 from the fill station through the "advance to pour" sector XY at the high speed rate. Under these conditions, the filled ladle will overtake the preceding ladle already in the pouring station. To eliminate the impact of the carriage moving into the pouring station on the preceding carriage already there, the drive motor 390 is slowed down by on and off control valve A mounted on a leading edge of the carriage 56. This on-off control valve A has a long stem or probe 416 (see FIG. 11) extending well forward of the advancing carriage. The stem or probe 416 of the control valve A engages the preceding carriage in the pouring station and acting in concert with the rest of the pneumatic circuit effects a slowing down of the air motor 390 of the advancing carriage. Hence the advancing carriage moves slowly into contact with the carriage ahead for engagement, locating and locking as described above.

Although this invention has been disclosed in terms of specific embodiments thereof, other embodiments will be readily apparent to those skilled in the art. Therefore it is not intended to limit the scope of this invention by the embodiments selected for the purpose of this disclosure but only by the claims which follow.

What is claimed is:

1. An automatic continuous pouring line for transferring predetermined amounts of molten metal from a stationary source of molten metal to a moving conveyor line of molds adapted to receive said predetermined amounts, comprising: a track defining a closed path between a ladle filling station at the source, a mold pouring station along a section of the track parallel to the conveyor line and back to the source; a plurality of ladle carriages adapted to sequentially, unidirectionally and independently traverse said track; a ladle supported on each of said carriages and rotatable between a first position for receiving and carrying said predetermined amount of molten metal and a second position for pouring said predetermined amount of molten metal into one of said molds while moving through said pouring station; separate drive means for each carriage for driving said carriage independently of the other carriages from said pouring station to said source for filling the ladle and thereafter back to said pouring station for pouring the molds; means for deactivating said separate drive means at said source during said filling and reactivating it after said filling to drive said carriage and filled ladle to said mold pouring station; means for locating said carriage with a mold at the pouring station, and locating means registering said carriage with said mold and synchronizing the movement of said carriage with the conveyor line during pouring; means on each carriage for rotating its ladle from said first position to said second position when the carriage has engaged a preceding carriage in the pouring station and is moving in unison with the conveyor line so as to pour molten metal from the ladle into the mold registered therewith, said rotating means returning said ladle to the first position when the ladle is empty; and an automatic control system for initially sensing the presence of a preceding carriage in the pouring station and effecting said locating and rotating and for thereafter sensing the presence of a succeeding carriage in the pouring station and effecting said driving from said pouring station after the ladle is emptied.

2. A pouring machine for transferring molten metal from a source of molten metal to molds traveling along a conveyor line, comprising: a track defining a closed-loop between a filling station adjacent the source and a pouring station adjacent the conveyor line; a plurality of self-driven and self-controlled carriages each movable along said track independently of the other carriages; a ladle rotatably supported on each of said carriages, eac of said ladles adapted to receive molten metal from the source at the filling station and to dispense the molten metal at the pouring station; separate drive means for each of said carriages for unidirectionally moving its associated carriage between said stations along said track; means for automatically stopping said carriage at said source with the carriage's ladle in registry with the source for receiving metal therefrom; means for locating said carriage at a mold in the pouring station, said locating means coupling the carriage to said line for registering the ladle with the mold to be poured and for synchronizing the movement of the carriage with said line in the pouring station; means for rotating said ladle to dispense its contents into a mold registered therewith in the pouring station, and returning the ladle to its metal receiving position when it is emptied; means adapted to sense the presence of a preceding carriage in the pouring station to effect said coupling and said rotation; and means adapted to sense the presence of a following carriage in the pouring station to effect uncoupling of said locating means and said moving of said carriage from the pouring station to the filling station.

3. A continuous pouring line for transferring molten metal from a stationary source of molten metal to a moving conveyor line of molds, comprising: a track defining a closed path between a ladle filling station at the source, a mold pouring station along a section of the track parallel to the conveyor line and back to the source; a plurality of ladle carriages adapted to transverse said track; a ladle supported on each of said carriages and rotatable about an axis substantially perpendicular to said track between a first filling and carrying position and a second pouring position; separate motor means for each carriage for driving said carriage independently of the other carriages to said source for filling the ladle and thereafter to said pouring station for pouring the molds; means for stopping said motor at said source during said filling; means for locating said carriage with a mold at the pouring station, said locating means coupling said carriage to said line to register the carriage's ladle with said mold and to synchronize the movement of said carriage and said mold through the pouring station; motor means on each carriage for rotating each ladle from said first position to said second position when its associated carriage has engaged a preceding carriage in the pouring station, its ladle is registered with a mold to be poured, and both carriage and mold are moving in unison through the pouring station, said motor returning said ladle to the first position when the ladle is empty; means for automatically sensing engagement between a carriage entering the pouring station with a carriage already therein for effecting said locating and rotation; and means for automatically sensing engagement of a succeeding carriage in the pouring station for effecting an uncoupling of said carriage and its removal from the pouring station after its ladle is emptied.

4. A continuous pouring line for transferring molten metal from a stationary source of molten metal to a moving conveyor line of molds, comprising: a track defining a closed path between a ladle filling station at the source, a mold pouring station along a section of the track parallel to the conveyor line and back to the source; a plurality of ladle carriages adapted to traverse said track; a ladle supported on each of said carriages and rotatable about an axis substantially perpendicular to said track between a first filling and carrying position and a second pouring position; separate motor means for each carriage for driving said carriage independently of the other carriages to said source for filling the ladle and thereafter to said pouring station for pouring the molds; means for braking said carriage at said source to stall said motor while the ladle is filled and thereafter release said carriage and unstall said motor for driving the carriage to the pouring station; means for locating said carriage with a mold at the pouring station, said locating means coupling said carriage to said line to register the carriage's ladle with said mold and to synchronize the movement of said carriage and said mold through the pouring station; motor means on each carriage for rotating each ladle from said first position to said second position when its associated carriage has engaged a preceding carriage in the pouring station, its ladle is registered with a mold to be poured, and both carriage and mold are moving in unison through the pouring station, said motor returning said ladle to the first position when the ladle is empty; means for automatically sensing engagement between a carriage entering the pouring station with a carriage already therein for effecting said locating and rotation; and means for automatically sensing engagement of a succeeding carriage in the pouring station for effecting an uncoupling of said carriage and its removal from the pouring station after its ladle is emptied.

5. A continuous pouring line for tranferring molten metal from a stationary source of molten metal to a moving conveyor line of molds, comprising: a track defining a closed path between a ladle filling station at the source, a mold pouring station along a section of the track parallel to the conveyor line and back to the source; a plurality of ladle carriages adapted to traverse said track; a ladle supported on each of said carriages and rotatable about an axis substantially perpendicular to said track between a first filling and carrying position and a second pouring position; separate motor means for each carriage for driving said carriage independently of the other carriages to said source for filling the ladle and thereafter to and through said pouring station for pouring the molds; means for stopping said motor at said source during said filling; means for locating said carriage with a mold at the pouring station, said locating means coupling said carriage to said line to register the carriage's ladle with said mold and to brake the carriage's movement with the mold line through the pouring station; motor means on each carriage for rotating each ladle from said first position to said second position when its associated carriage has engaged a preceding carriage in the pouring station, its ladle is registered with a mold to be poured, and both carriage and mold are moving in unison through the pouring station, said motor returning said ladle to the first position when the ladle is empty; means for automatically sensing engagement between a carriage entering the pouring station with a carriage already therein for effecting said locating and rotation; and means for automatically sensing engagement of a succeeding carriage in the pouring station for effecting an uncoupling of said carriage and its removal from the pouring station after its ladle is emptied.

6. A continuous pouring line for transferring molten metal from a stationary source of molten metal to a moving conveyor line of successive molds wherein said conveyor line includes an arcuate pouring section, comprising: a horizontal support base; a support post extending on the base and defining a vertical axis coaxial with the arcuate section; a circular track on said base coaxial with said post and the arcuate section, said track having a filling section adjacent the source and a pouring section parallel to the conveyor line; a plurality of independent carriages pivotally connected at said post for rotation thereabout and supported on for movement along said circular track; a ladle supported on each of said carriages for rotation about a horizontal axis, said ladle being rotatable between a first position for receiving and carrying molten metal from the source and a second position for pouring molten metal therefrom; independently controlled drive means on each carriage engageable with the track for independently unidirectionally driving said carriages and associated ladle therearound; means for locating the carriage and ladle at said source and for disengaging the drive means thereat while said ladle is in said first position and being filled with molten metal; means for engaging said drive means after said ladle is filled with molten metal to drive said carriage and associated filled ladle to said pouring section; means for locating the carriage and the associated filled ladle at the mold in the pouring section; means for disengaging said drive means when a preceding ladle is engaged and said last mentioned means for locating is operative thereby synchronizing movement of said carriage with movement of the line so as to maintain said ladle in registry with the mold; means for rotating said ladle from said first position to said second position when said carriage movement is synchronized with the movement of the line and said carriage has engaged a preceding carriage so as to deliver molten metal to said mold when said ladle is in registry therewith; means for returning the ladle to the first position when the pouring is completed; and means engaging said drive means when a following ladle has engaged the carriage and the pouring is completed thereby returning said carriage to the source for refilling.

7. A continuous mechanical iron pourer for sequentially delivering a metered supply of molted iron sufficient for a single mold from a filling station to a series of molds traveling along a conveyor line, said line having a circular sector defining a pouring station comprising: a horizontal support base; a vertically upwardly extending support post defining a vertical axis coaxial with the circular sector; a circular track defining a continuous path between said filling station and said pouring station, said track being coaxial with the pouring station; a plurality of power-and-free carriages pivotally connected to said support post and supported on the track for independent rotational movement about said vertical axis; a ladle supported on each of said carriages for rotation about a radially extending horizontal axis, said ladle having a holding cavity adapted to receive said metered supply of molten iron at said filling station when in a filling position and positioned in registry with the filling station, said ladle having a pouring nozzle for delivering molten iron from the cavity in a pouring position when positioned in registry with the molds at said pouring station; a first motor operative to rotate the ladle between said positions; drive means including a motor on said carriage operative to drive said carriage around said circular track; control means for engaging said second motor to drive said carriage after said ladle has been filled with molten iron at said filling station to thereby advance the filled ladle and carriage from the filling station; an extendable locating mechanism engageable with the filling station and the individual molds to fixedly position the carriage and ladle thereat; means for extending said mechanism at said pouring station to engage the carriage with an associated mold; control means for disengaging said second motor when the ladle is in registry with the mold such that the ladle is driven by and in synchronization with the conveyor line; means for actuating the first motor to rotate said ladle at said pouring station from said filling position to said pouring position to convey molten iron into said mold and to return said ladle to said filling position after pouring is completed; means for retracting said mechanism after completion of said pouring; and control means for engaging said second motor to drive said carriage to said filling station and for disengaging said drive means and for engaging locating means at the filling station to lock said carriage thereat until said ladle is filled with molten iron.

8. An air operated continuous mechanical iron pourer for sequentially delivering a metered supply of molten iron sufficient for a single mold from a filling station to a series of molds traveling along a conveyor line, said line having a circular sector defining a pouring station comprising: a horizontal support base; a vertically upwardly extending support post defining a vertical axis coaxial with the circular sector; a circular track defining a continuous path between said filling station and said pouring station, said track being coaxial with the circular sector; a plurality of power-and-free carriages pivotally connected to said support post and supported on the track for independent rotational movement about said vertical axis; a ladle supported on each of said carriages for rotation about a radially extending horizontal axis, said ladle having a holding cavity adapted to receive said metered supply of molten iron at said filling station when in a filling position and positioned in registry with the filling station, said ladle having a pouring nozzle for delivering molten iron from the cavity while in a pouring position when positioned in registry with the molds at said pouring station; a first air motor connected to an air supply operative to rotate the ladle between said positions; variable speed drive means on said carriage including a second air motor connected to said air supply operative to drive said carriage around said circular track; control means for engaging said second air motor (*a*) to drive said carriage at a slow speed after said ladle has been filled with molten iron at said filling station to thereby advance the filled ladle and carriage from the filling station, (*b*) to drive said filled ladle and carriage at a faster speed at a first predetermined location along said path, and thereafter (*c*) return to said slow speed at a second predetermined location along said path to drive said filled ladle and carriage to said pouring station; an extendable locating mechanism engageable with the filling station and the individual molds to fixedly position the carriage and ladle thereat; means for extending said mechanism at said pouring station to engage the carriage with an associated mold; control means disengaging said second air motor at the mold when the pouring nozzle and ladle are in registry with the mold such that the ladle is driven by and in synchronization with the conveyor line; means for actuating the first air motor to rotate said ladle at said pouring station from said filling position to said pouring position to convey molten iron through said pouring nozzle into said mold and to return said ladle to said filling position after pouring is completed; means for retracting said mechanism after completion of said pouring; control means engaging said second air motor to drive said carriage at said slow speed until a third predetermined location along said path, and thereafter at said faster speed to a fourth predetermined location along said path before said filling station, said means slowing said second air motor to said slow speed at said fourth predetermined location preparatory to filling; and control means for disengaging said drive means foı engaging said locating mechanism at said filling station to lock said carriage thereat until said ladle is filled with molten iron.

9. A continuous pouring line of transferring molten metal from a stationary source of molten metal to a moving conveyor line of molds, comprising: a track defining a closed path between a ladle filling station at the source, a mold pouring station along a section of the track parallel to the conveyor line and back to the source; a plurality of ladle carriages adapted to traverse said track; a ladle supported on each of said carriages and rotatable between a first position for receiving and carrying molten metal and a second position for pouring molten metal; separate drive means for each carriage for driving said carriage independently of the other carriages to said source for filling the ladle and thereafter to said pouring station for pouring the molds; means for disengaging said drive means at said source during said filling; means for engaging said drive means after said filling to drive said carriage and filled ladle to said mold pouring station; means for locating said carriage with a mold at the pouring station, said locating means locking said carriage in registry with said mold and synchronizing the movement of said carriage with the conveyor line; means for automatically disengaging the drive means of the carriage entering the pouring station when that carriage engages a preceding carriage at the pouring station and said locating means is engaged such that the entering carriage is driven by the conveyor line; means for automatically rotating each ladle from said first position to said second position when its associated carriage has engaged a preceding carriage in the pouring station and is moving in unison with the conveyor line so as to pour molten metal from the ladle into the mold registered therewith, said rotating means returning said ladle to the first position when the ladle is empty; and means for automatically engaging said drive means to remove said carriage from the pouring station after (*a*) the ladle is emptied and (*b*) a following carriage has engaged the carriage bearing the empty ladle.

10. An automatic continuous pouring line for transferring predetermined amounts of molten metal from a stationary source of molten metal to a moving conveyor line of molds adapted to receive said predetermined amounts, comprising: a track defining a closed path between a ladle filling station at the source, a mold pouring station along a section of the track parallel to the conveyor line, and back to the source; a plurality of self-powered and self-controlled ladle carriages adapted to sequentially and unidirectionally traverse said track; a ladle supported on each of said carriages and rotatable between a first position for receiving and carrying said predetermined amount of molten metal and a second position for pouring said predetermined amount of molten metal into one of said molds while moving through said pouring station; separate motor means carried by each said carriage for rotating said ladle between said first and second positions; separate drive means for each carriage for driving said carriage independently of the other carriages to said source for filling the ladle and thereafter to said pouring station for pouring the molds; means for automatically effecting a stopping of said drive means and a locating of said ladle with respect to said source at the ladle filling station, and a starting of said drive means following filling for transporting the filled ladle to said mold pouring station; means on each carriage responsive to engagement with a preceding carriage in the pouring station for locating said carriage with a mold at the pouring station while both said carriage and mold are moving together therein, said locating means coupling said carriage to said conveyor line for maintaining the located carriage's ladle in precise pouring registry with the mold to be poured and for synchronizing the movement of said carriage with the conveyor line while moving through said pouring station; means on each carriage adapted to engage a preceding carriage for automatically engaging said mold locating means when engagement with the preceding carriage at the pouring station occurs; means for automatically effecting the rotation of each ladle from said first position to said second position when the ladle's carriage is in engagement with a preceding carriage in the pouring station and is coupled and moving in unison with the conveyor line so as to pour molten metal from the ladle into the mold registered therewith, and from said second position to said first position when the ladle is empty; and means on each carriage adapted to be engaged by a following carriage in the pouring station for automatically disengaging said mold locating means to uncouple the carriage from the conveyor line for its return to the source after (*a*) the ladle is emptied and (*b*) a following carriage has engaged the carriage bearing the empty ladle.

* * * * *

UNITED STATES PATENT AND TRADEMARK OFFICE

CERTIFICATE OF CORRECTION

PATENT NO. : 3,977,461

DATED : August 31, 1976

INVENTOR(S) : Kenneth J. Pol, William E. Willis

It is certified that error appears in the above-identified patent and that said Letters Patent are hereby corrected as shown below:

Column 14, Line 69 (Claim 3) "to trans" should read --to tra--.
Column 18, Line 50 (Claim 9) "line of" should read --line for--.

Signed and Sealed this

Twenty-third Day of November 1976

[SEAL]

*Attest:*

RUTH C. MASON
*Attesting Officer*

C. MARSHALL DANN
*Commissioner of Patents and Trademarks*

UNITED STATES PATENT AND TRADEMARK OFFICE

CERTIFICATE OF CORRECTION

PATENT NO. : 3,977,461

DATED : August 31, 1976

INVENTOR(S) : Kenneth J. Pol, William E. Willis

It is certified that error appears in the above-identified patent and that said Letters Patent are hereby corrected as shown below:

Col. 3, line 26, delete "with" and substitute -- from --;
Col. 4, line 18, delete "lead" and substitute -- load --;
Col. 4, line 43, delete "of" and substitute -- or --;
Col. 6, line 20, delete "carriages" and substitute -- carriage --;
Col. 8, line 3, delete "whe" and substitute -- when --;
Col. 8, line 19, the word -- relay -- should be inserted after "four-way";
Col. 9, line 67, delete "pilot" and substitute -- point --;
Col. 10, line 48, delete "332" and substitute -- 332 --;
Col. 13, line 16, the words -- the inside of -- should be inserted after "on";
Col. 13, line 25, delete "of" and substitute -- and --;
Col. 14, line 15, delete "and" and substitute -- said --;
Col. 14, line 39, delete "eac" and substitute -- each --; and
Col. 18, line 47, the word -- and -- should be inserted after "means".

Signed and Sealed this

Tenth Day of May 1977

[SEAL]

*Attest:*

RUTH C. MASON
*Attesting Officer*

C. MARSHALL DANN
*Commissioner of Patents and Trademarks*